US010518124B2

(12) United States Patent
Johnston

(10) Patent No.: US 10,518,124 B2
(45) Date of Patent: Dec. 31, 2019

(54) PIVOTING STEPPER APPARATUS

(71) Applicant: Gary Lawrence Johnston, Cowarts, AL (US)

(72) Inventor: Gary Lawrence Johnston, Cowarts, AL (US)

( * ) Notice: Subject to any disclaimer, the term of this patent is extended or adjusted under 35 U.S.C. 154(b) by 89 days.

(21) Appl. No.: 15/947,823

(22) Filed: Apr. 8, 2018

(65) Prior Publication Data

US 2019/0308063 A1 Oct. 10, 2019

(51) Int. Cl.
*A63B 22/00* (2006.01)
*A63B 21/22* (2006.01)
*A63B 21/008* (2006.01)

(52) U.S. Cl.
CPC ..... *A63B 22/0056* (2013.01); *A63B 21/0083* (2013.01); *A63B 21/225* (2013.01)

(58) Field of Classification Search
CPC ... A63B 21/0083; A63B 22/005; A63B 21/02; A63B 2022/00; A63B 22/00
See application file for complete search history.

(56) References Cited

U.S. PATENT DOCUMENTS 5,199,932 A * 4/1993 Liao ..... A63B 22/001 482/113
5,199,933 A * 4/1993 Illuzzi ..... A63B 23/0476 482/62
5,256,117 A * 10/1993 Potts ..... A63B 21/157 482/52
5,284,461 A * 2/1994 Wilkinson ..... A63B 21/4047 482/147
5,298,002 A * 3/1994 Lin ..... A63B 22/0058 482/53
5,453,065 A * 9/1995 Lien ..... A63B 22/0056 482/146
5,807,210 A * 9/1998 Devlin ..... A63B 22/0056 482/146
5,879,276 A * 3/1999 Miller ..... A63B 22/14 482/131
6,582,344 B2 * 6/2003 Tang ..... A63B 21/068 482/147
6,918,857 B2 * 7/2005 Chen ..... A63B 22/0056 482/53

(Continued)

*Primary Examiner* — Garrett K Atkinson

(57) ABSTRACT

A Pivoting Stepper Apparatus comprising a Frame Structure Member, a Foot Engagement Member, and an optional Resistance Member. The Frame Structure Member is comprised basically of a Base Frame Member and a Guide Platform Member. The Foot Engagement Member is pivotally mounted to the Base Frame Member and mainly comprises two Foot Support Members pivotally coupled together by a lever assembly such that they move in reciprocating upward and downward motions. The lever assembly is a dual lever assembly which keeps the Foot Support Member in a relatively horizontal position while moving upward and downward. The Foot Support Members operatively engage the Guide Platform Member, with the upward and downward movements of the Foot Support Members create the pivoting movement of the Foot Engagement Member, and vice versa. The optional Resistance Member provides resistance in the pivoting motion of the Foot Engagement Member, and thus also in the upward and downward movements of the Foot Support Members.

21 Claims, 7 Drawing Sheets

(56) References Cited

U.S. PATENT DOCUMENTS

| | | | | |
|---|---|---|---|---|
| 7,658,698 | B2 * | 2/2010 | Pacheco | A63B 21/157 482/52 |
| 7,686,743 | B2 * | 3/2010 | Eschenbach | A63B 21/015 482/51 |
| 8,025,608 | B2 * | 9/2011 | Popescu | A63B 23/1209 482/111 |
| 8,047,968 | B2 * | 11/2011 | Stewart | A63B 22/001 482/51 |
| 10,179,265 | B2 * | 1/2019 | Carr | A63B 24/0087 |
| 2003/0216223 | A1 * | 11/2003 | Chuang | A63B 22/0056 482/53 |
| 2005/0227818 | A1 * | 10/2005 | Liao | A63B 21/015 482/53 |
| 2006/0019801 | A1 * | 1/2006 | Zeng | A63B 22/0064 482/52 |
| 2006/0229166 | A1 * | 10/2006 | Fan | A63B 22/001 482/53 |
| 2008/0032869 | A1 * | 2/2008 | Pacheco | A63B 21/157 482/52 |

* cited by examiner

PIVOTING STEPPER APPARATUS

BACKGROUND OF THE INVENTION

This invention relates to a Pivoting Stepper Apparatus composed of a Frame Structure Member, a Foot Engagement Member, and an optional Resistance Member. The Frame Structure Member is comprised basically of a Base Frame Member and a Guide Platform Member. The Foot Engagement Member is pivotally mounted to the Base Frame Member and mainly comprises two Foot Support Members pivotally coupled together such that they move in reciprocating upward and downward motions. The Foot Support Members are also pivotally mounted to the Base Frame Member and operatively engage the Guide Platform Member. The unique construction of the apparatus allows the user to perform a stepping type routine, with the stepping motion of the user creating a pivoting motion in the user. An optional Resistance Member mounted to the Base Frame Member may be provided which operatively engages the Foot Engagement Member and provides a resistance to the movements of the Foot Sport Members.

SUMMARY AND OBJECTS OF THE INVENTION

It is the object of this invention to provide a Pivoting Stepper Apparatus which may provide the user a unique and effective exercise routine for exercising mainly lower body muscle groups. The main purpose of this application is to demonstrate an apparatus which performs the stated function, and to demonstrate the many options and configurations this apparatus may take on.

Briefly stated, the apparatus that forms the basis of the present invention comprises a Frame Structure Member, a Foot Engagement Member, and an optional Resistance Member. The Frame Structure Member is basically comprised of a Base Frame Member having Inner, Outer, and Cross Support Members, and a Guide Platform Member. An optional Handle Member may also be part of the Frame Structure Member. The Foot Engagement Member is basically comprised of two Foot Support Members pivotally coupled together using a Dual Lever Assembly, which itself is pivotally mounted to a Lever Support Member. The Dual Lever Assembly allows the Foot Pedal Members to maintain a substantially horizontal position while they move in a reciprocating upward and downward motion. The Lever Support Member is also pivotally mounted to the Base Frame Member. The two Foot Support Members may also each contain a Platform Engaging Member, which engages the Guide Platform Member of the Frame Structure Member and produces a pivoting motion in the Foot Engagement Member.

An optional Resistance Member may also be part of the apparatus. Several different conventional resistance assemblies are available, with one of the more common being a closed loop chain and sprocket type assembly. When this type is used, the Foot Engagement Member would also include a Resistance Connection Member which may be mounted to, and pivot in conjunction with, the Lever Support Member. The Resistance Member would then be comprised of a Resistance Rotatable Member which operatively connects to the Resistance Connection Member through a Closed Loop Connection Member. The Closed Loop Connection Member would be a chain, and the Resistance Rotatable Member and Resistance Connection Member would be a sprocket. A Resistance Generator, such as a magnetic brake or electromagnetic system, would also be used to vary resistance. A flywheel may also be part of the Resistance Member, as is commonly found in a large number of fitness products.

The unique configuration of the apparatus allows the apparatus to be used as a stepper machine, with the stepper portion of the apparatus simultaneously pivoting in the side to side directions. This pivoting motion is created by the engagement of the Platform Engaging Member of the Foot Engagement Member and the Guide Platform Member of the Frame Structure Member. The Guide Platform Member is slanted downward towards the Foot Engagement Member. As one of the Foot Pedal Members moves downward and engages the Guide Platform Member, the Foot Support Member moves away from the Guide Platform Member. This causes the other Foot Support Member to move upward and towards the Guide Platform Member. Thus, the reciprocating movement of the Foot Support Members creates the pivoting motion of the Foot Support Members.

The Pivoting Stepper Apparatus has a unique design which is not found in other stepper type products. A stepper assembly which pivots, as the foot pedals move upward and downward, greatly Increases the flexibility of the apparatus. This provides a much better exercise routine for the lower body than all other stepper type products.

BRIEF DESCRIPTION OF THE DRAWINGS

FIG. 18 is a top view of the Pivoting Stepper Apparatus.

FIG. 28 is a top view of the Frame Structure Member of the Pivoting Stepper Apparatus.

FIG. 40 is a top view of a second type of Resistance Member of the Pivoting Stepper Apparatus.

DETAILED DESCRIPTION OF THE PREFERRED EMBODIMENT

Figure 1B:
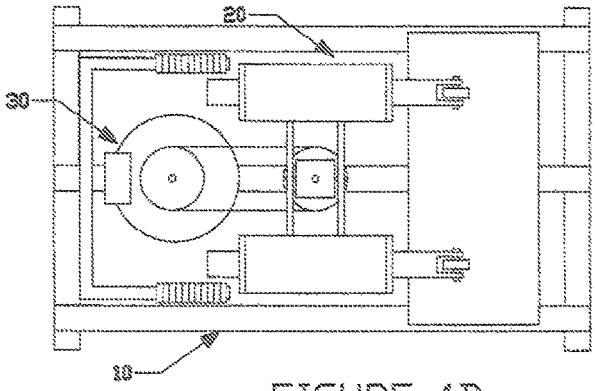
FIG. 1A is a front view of the Pivoting Stepper Apparatus.
FIG. 1C is a side view of the Pivoting Stepper Apparatus.
FIG. 1D is a second side view of the Pivoting Stepper Apparatus.
Figure 1D:
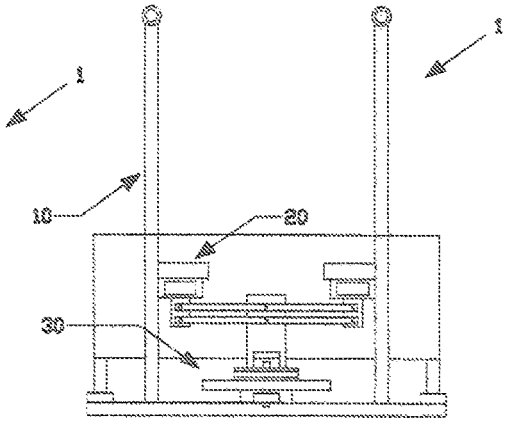
Figure 1A:
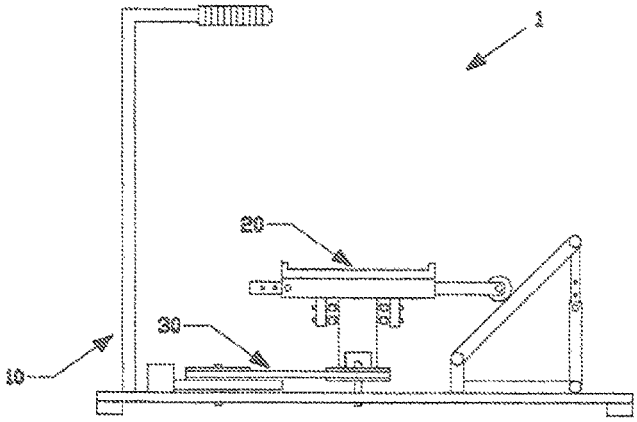
Figure 1C:
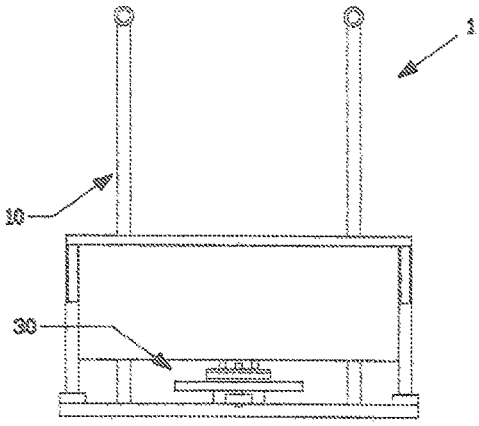

Before explaining in detail the present invention, it is to be understood that the invention is not limited in its application to the details of construction or arrangement of parts Illustrated in the accompanying drawings, since the invention is capable of other embodiments and of being practiced or carried out in various ways. Also, it is to be understood that the phraseology and terminology employed herein is for the purpose of description, and not limitation.

As best can be seen by references to the drawings, and in particular to FIGS. 1A-1D, the Pivoting Stepper Apparatus that forms the basis of the present invention is designated generally by the reference numeral 1, and includes a Frame Structure Member 10, a Foot Engagement Member 20, and optional Resistance Member 30. The Foot Engagement Member 20 is pivotally mounted to the Frame Structure Member 10 in such a manner that the Foot Engagement Member 20 may pivot in the side to side directions. The option Resistance Member 30 may be used to provide a resistance to the movements of the Foot Engagement Member.

Figure 2B:
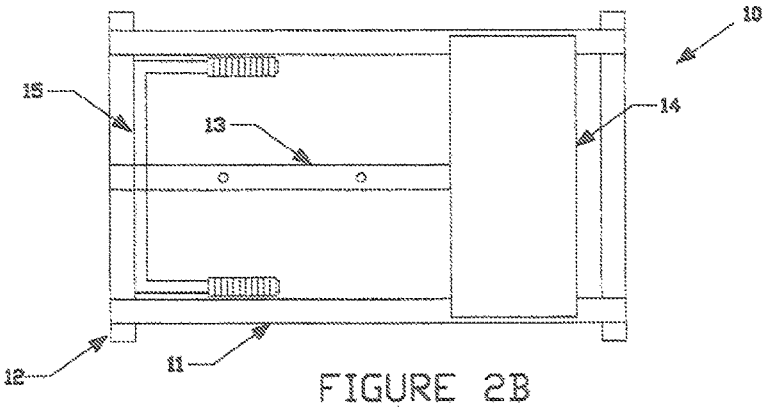
FIG. 2A is a front view of the Frame Structure Member of the Pivoting Stepper Apparatus.
FIG. 2C is a side view of the Frame Structure Member of the Pivoting Stepper Apparatus.
Figure 2A:
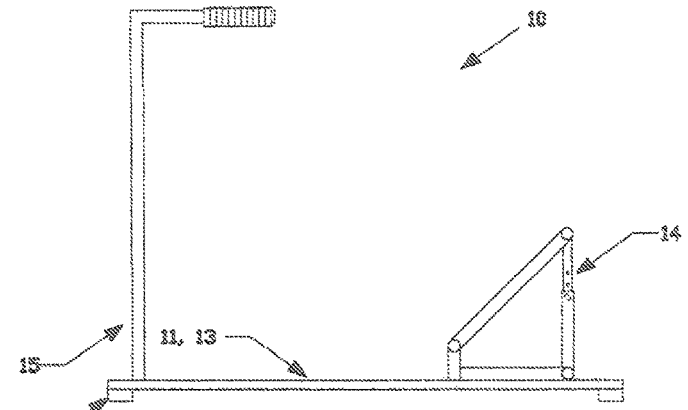
Figure 2C:
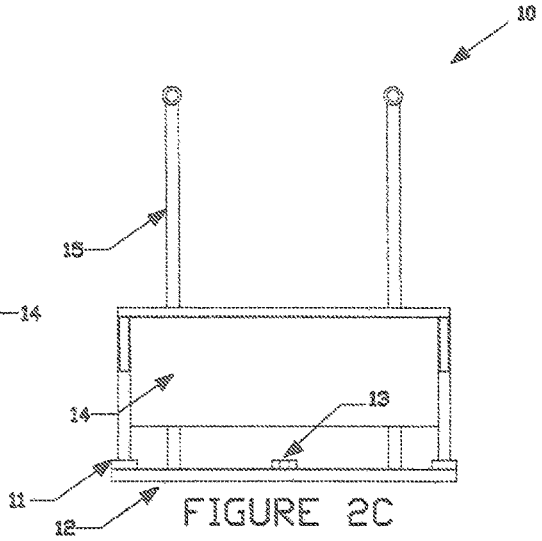

As may be seen in FIGS. 2A-2C, the Frame Structure Member 10 may comprise a base frame member with Outer Support Members 11, Cross Support Members 12, and an Inner Support Member 13. As may be seen, the Outer Support Members 11 are located on each side of the apparatus, and extend from the front of the apparatus to the rear of the apparatus. The Cross Support Members 12 rigidly connects the Outer Support Members together. The Inner Support Member 13 is similar to the Outer Support Members 11 in that it also extends from the front to the rear of the apparatus, with the Cross Support Members 12 also being rigidly mounted to it. This creates a rigid base frame member. Also included in the Frame Structure Member 10 is a Guide Platform Member 15, which includes a relatively flat platform mounted to the base frame member at a predetermined angle. An optional Handle Member 15 may also be part of the Frame Structure Member.

Figure 3B:
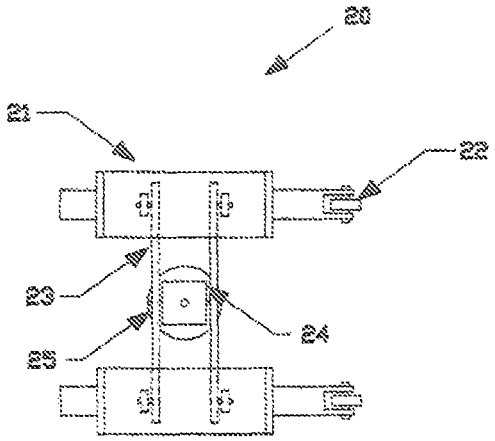
FIG. 3B is a top view of the Foot Engaging Member of the Pivoting Stepper Apparatus.
Figure 3A:
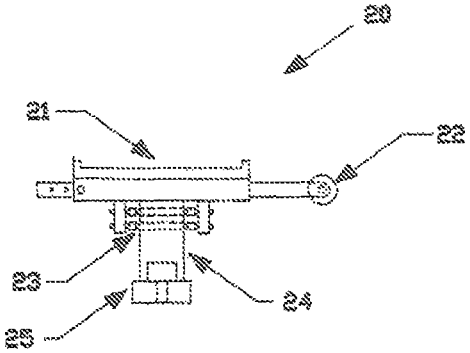
FIG. 3A is a front view of the Foot Engaging Member of the Pivoting Stepper Apparatus.
Figure 3C:
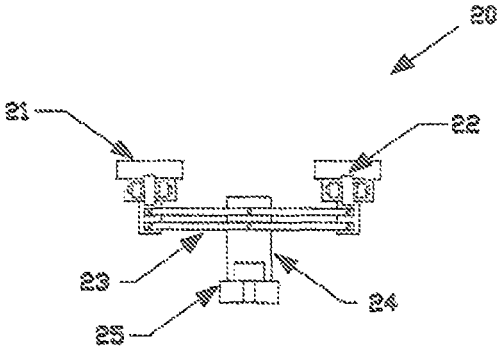
FIG. 3C is a side view of the Foot Engaging Member of the Pivoting Stepper Apparatus.

FIGS. 3A-3C shows the Foot Engagement Member 20 of the Pivoting Stepper Apparatus. As shown, the Foot Engagement Member 20 includes two Foot Support Members 21. These Foot Support Members 21 are generally horizontal, and are sized to support the bottom feet part of a typical user. They are connected together using a Dual Lever Assembly 23. Dual Lever Assembly 23 is basically comprised of two levers, each pivotally mounted at its proximate center to a Lever Support Member 24, and pivotally mounted at their opposite ends to the Foot Support Members 21. The Dual Lever Assembly provides a reciprocating upward and downward motion in the Foot Support Members 21, while also allowing the Foot Support Members to maintain a substantially horizontal position. The Lever Support Member 24 of the Foot Engagement Member 30 pivotally mounts at its lower area to the Inner Support Member of the Frame Structure Member, so that the Foot Engaging Member 20 may pivot in the side to side directions. The Foot Engaging Member 20 also Includes a Platform Engaging Member 22 connected to each Foot Support Member for engaging the Guide Platform Member of the Frame Structure Member. Foot Engagement Member 20 also has a Resistance Connector Member 25 for connecting to the Resistance Member 30, when once is utilized.

Figure 4B:
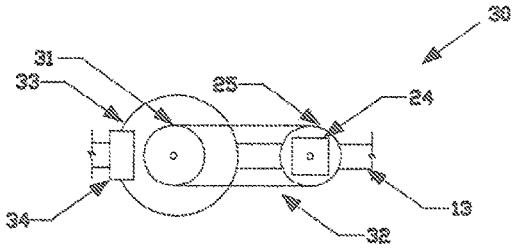
FIG. 4B is a top view of the Resistance Member of the Pivoting Stepper Apparatus.
Figure 4D:
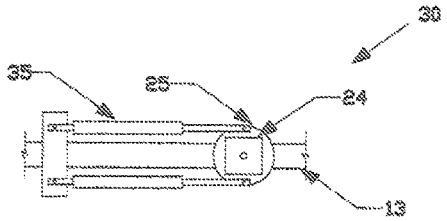
FIG. 4A is a front view of the Resistance Member of the Pivoting Stepper Apparatus.
FIG. 4C is a side view of the Resistance Member of the Pivoting Stepper Apparatus.
Figure 4A:
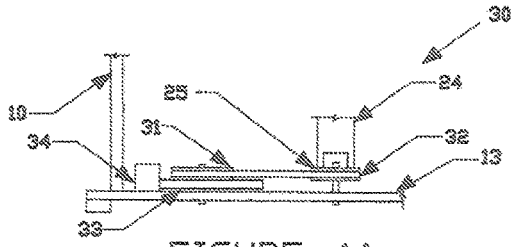
Figure 4C:
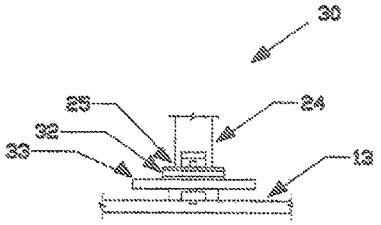

FIGS. 4A-4C shows an optional Resistance Member 30, which may also be part of the Pivoting Stepper Apparatus. The Resistance Member 30 includes a Resistance Rotatable Member 31, a Closed Loop Connection Member 32, a flywheel 33, and a Resistance Generator Member 34. The Resistance Member 30 thus demonstrates a convention type of chain, sprocket, flywheel, and resistance device assembly which is commonly used on fitness products. The Resistance Member 30 shown connects to the Foot Engagement Member through its Resistance Connector Member. FIG. 40 demonstrates a Resistance Member 30 shows a different type of resistance concept which utilizes conventional Resistance Cylinders 35, as is also commonly found in many fitness products. In this instance, the Resistance Cylinders 34 are pivotally mounted at one end to the base frame structure, and pivotally mounted at their other ends to the Resistance Connector Member 25 of the Foot Engagement Member.

Figure 5A:
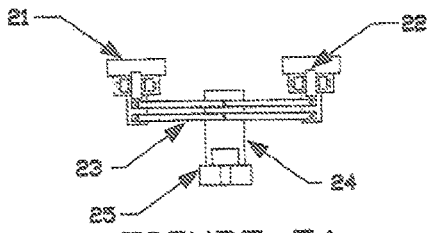
FIGS. 5A, 5B, and 5C are side views of the Pivoting Stepper Apparatus demonstrating its operation.
Figure 5B:
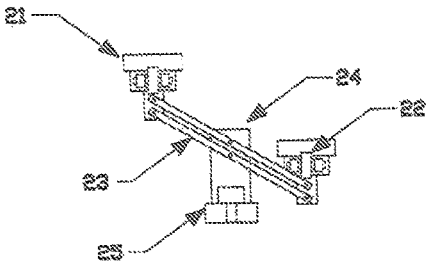
Figure 5C:
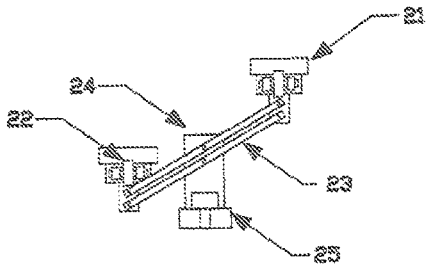

FIGS. 5A-5C are several side views which demonstrate the operation of the Foot Engagement Member 20. As seen, the Dual Lever Assembly 23 is basically comprised of two levers, each pivotally mounted at its proximate center to a Lever Support Member 24, and pivotally mounted at their opposite ends to the Foot Support Members 21. The Dual Lever Assembly provides a reciprocating upward and downward motion in the Foot Support Members 21, while also allowing the Foot Support Members to maintain a substantially horizontal position. Since the length of the Lever Support Member remain constant, the Foot Support Members will follow a curved upward and downward path of motion, which provides better exercise than steppers in which the foot support members follows a straight upward and downward path of motion.

Figure 6A:
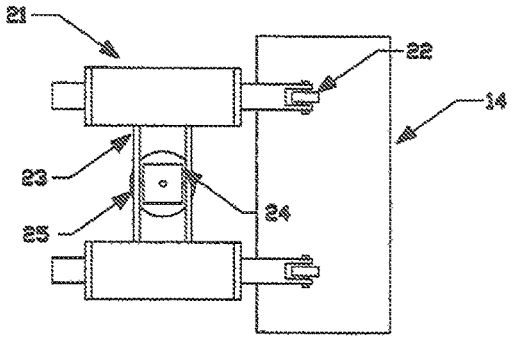
FIGS. 6A, 6B, and 6C are top views of the Pivoting Stepper Apparatus demonstrating its operation.
Figure 6B:
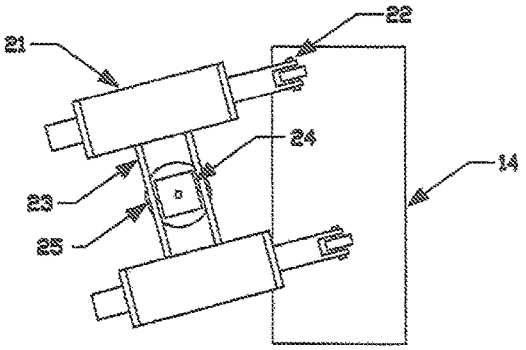
Figure 6C:
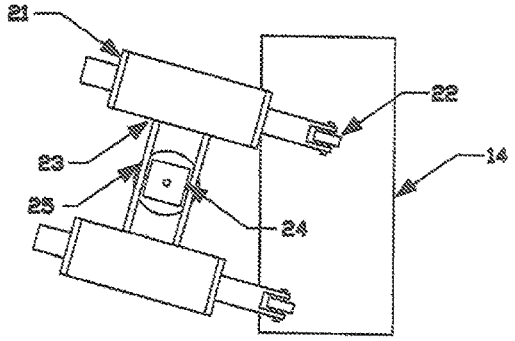

FIGS. 6A-6C are several top views which demonstrate the operation of the Foot Engagement Member 20 in conjunction with the Guide Platform Member 14 of the Frame Structure Member 10. As seen, the Foot Support Members 21 have Platform Engaging Members 22 which extend outward and engage the Guide Platform Member 14 as the Foot Support Members 21 move in the upward and downward directions. The Guide Platform Member is mounted to the base frame member at a predetermined angle, with the bottom of the Guide Platform Member being closest to the Foot Engagement Member 20. As the user presses downward upon one of the Foot Support Members 21, the Platform Engaging Member 22 engages the Guide Platform Member 14, causing the Foot Support Member 21 to move in the direction away from the Guide Platform Member 14 as it moves downward. When the user pushes downward upon the opposite Foot Support Member 21, it will also engage the Guide Platform Member 14, causing it to move in the direction away from the Guide Platform Member 14 as it moves downward. This back and forth movement of the Foot Support Members 21 causes the Foot Engagement Member 20 to pivot in the side to side directions. Thus, as the Foot Support Members move in the opposite upward and downward directions, they also move on the opposite forward and backward directions. FIGS. 5A-5C show the Foot Support Members from the view of the Guide Platform Member, and the positions of the Foot Support Members in FIGS. 6A-6C correspond directly with those shown in Figures SA-SC.

Figure 7:
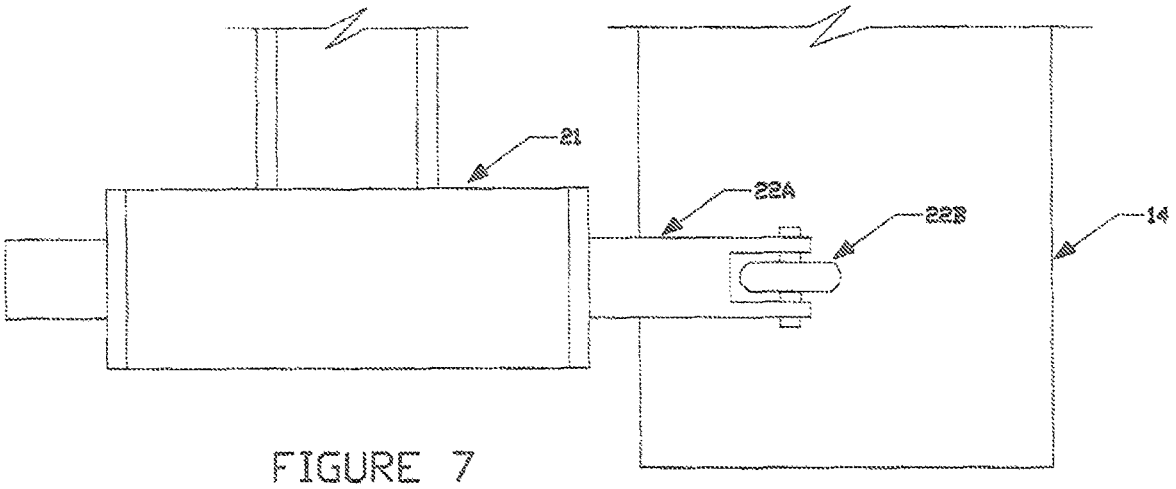
FIG. 7 is a top view demonstrating the engagement of the Foot Support Member of the Foot Engagement Member with the Guide Platform Member of the Frame Structure Member.

FIG. 7 is a demonstration of the engagement between the Platform Engaging Member 22 and the Guide Platform Member 14. It is preferable that each of the Platform Engaging Members 22 have a rigid Support Structure 22A which connects to and extends away from the respective Foot Support Member 22. At the ends of the each Support Structure 22A is a Wheel Component 22B, which rolls against the flat portion of Guide Platform Member 14. The outer surface of the Wheel Component 22B is preferably curved, so that it maintains better contact with the Guide Platform Member 14 as it moves in the backward forward, upward and downward motions along the platform surface. The path along which the Wheel Component 22B moves against the Guide Platform member 14 will be curved, and therefore the contact between the two will not be perpendicular to Support Structure 22 most of the time.

Figure 8A:
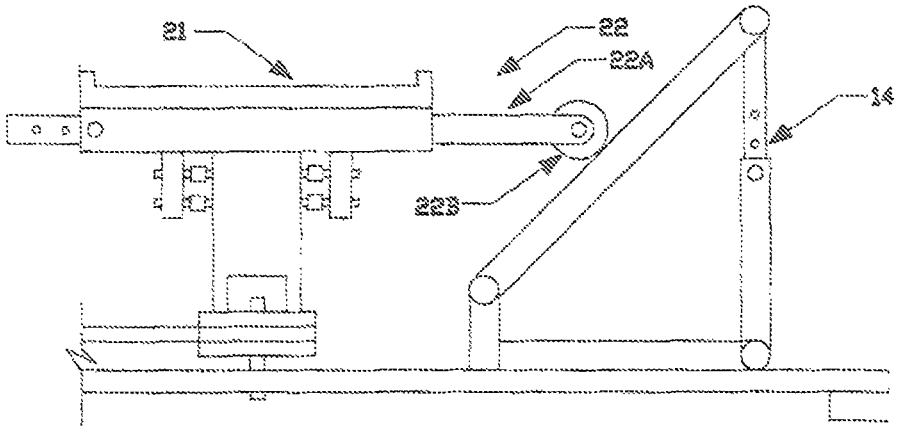
FIGS. 8A and 8B are side views of an adjustable connection between the Platform Engaging Member and the Foot Support Member of the Foot Engagement Member, and an adjustable Guide Platform Member of the Frame Structure Member.
Figure 8B:
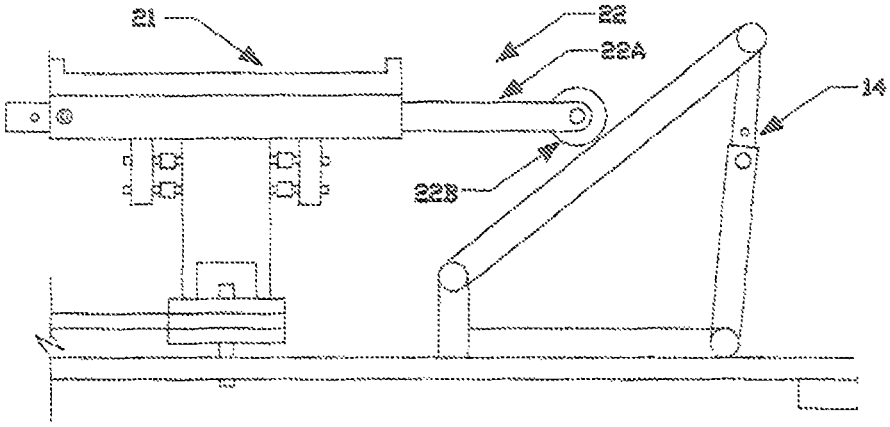

FIGS. 8A and 8B demonstrate adjustment features of the Platform Engaging Member 22 and the Guide Platform Member 14. By changing the angle at which the flat surface of the Guide Platform Member 14 is mounted, and by changing the distance between the Wheel Components 228 and the Foot Support Members 21, it is possible to change the amount of pivot in the Foot Engagement Member 20. Guide Platform Member 14 may have adjustable support members which allow its flat surface to be adjusted and secured at different angles. Also, the Support Structures 22A may be adjusted and secured along Foot Support Members 21 so that the distance between the Wheel Components 228 and Foot Support Members 21 may be altered in order to correctly operate with the new angle of the Guide Platform Member 14.

Many variations of the numerical display apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A pivoting stepper apparatus comprising;

a frame structure member having a base frame member with a guide platform member mounted thereon;

a foot engagement member having a lever support member pivotally mounted upon said base frame member of said fame structure member, a lever assembly pivotally mounted at its proximate center to said lever support member; two foot support members pivotally mounted to the end areas of said lever assembly such that said foot support members move in a reciprocating upward and downward motion; a platform engaging member mounted to each of said foot support members for operatively engaging said guide platform member of said frame structure member;

whereby a user may stand upon said foot support members of said foot engagement member and move said foot support members in a reciprocating upward and downward motion, said platform engaging members mounted to said foot support members operatively engaging said guide platform member such that the upward and downward movements of said foot support members of said foot engagement member creates pivoting movement in said lever support member of said foot engagement member, thus creating pivoting movement of said foot support members in the side to side directions as said foot support members move in the upward and downward directions.

2. A pivoting stepper apparatus as claimed in claim 1, said foot support members of said foot engagement member being generally horizontal in nature, said lever assembly of said foot engagement member being a dual lever assembly which comprises at least two levers, said dual lever assembly used to keep said foot support members of said foot engagement member in relatively horizontal positions.

3. A pivoting stepper apparatus as claimed in claim 1, said guide platform member of said frame structure member having a relative flat surface, said guide platform member being rigidly mounted to said base frame member of said frame structure member such that said flat surface of said guide platform member is positioned at an angle relative to said base frame member, said guide platform member being angled downward towards said foot engagement member.

4. A pivoting stepper apparatus as claimed in claim 3, each of said platform engaging member of said foot engagement member being an elongated rigid structure rigidly connected to said foot support member and extending towards said guide platform member, said platform engaging member having a wheel element mounted at its end area for rotatably engaging said flat surface of guide platform member.

5. A pivoting stepper apparatus as claimed in claim 4, each of said platform engaging member of said foot engagement member being adjustable and securable at various intervals along respective said foot support member of said foot engagement member; said guide platform member of said frame structure member being adjustable and securable at different angles along said base frame member of said frame structure member; such that the amount of said pivoting motion of said foot engagement member in the side to side directions may be selectively varied.

6. A pivoting stepper apparatus as claimed in claim 1 further comprising a resistance member mounted to said base frame member, said resistance member operatively engaging said lever support member of said foot engagement member, such that said resistance member provides resistance to said pivoting movement of said lever support member; and a handle member mounted to said base frame member.

7. A pivoting stepper apparatus as claimed in claim 6, said resistance member being a conventional chain and sprocket assembly with a flywheel and a resistance varying device.

8. A pivoting stepper apparatus as claimed in claim 1, said resistance member being a conventional resistance cylinder assembly with resistance varying features.

9. A pivoting stepper apparatus comprising;

a frame structure member having a base frame member with a guide platform member mounted thereon;

a foot engagement member having a lever support member pivotally mounted upon said base frame member of said fame structure member; a lever assembly pivotally mounted at its proximate center to said lever support member, two foot support members pivotally mounted to the end areas of said lever assembly such that said foot support members move in a reciprocating upward and downward motion; a platform engaging member mounted to each of said foot support members for operatively engaging said guide platform member of said frame structure member;

said foot support members of said foot engagement member being generally horizontal in nature, said lever assembly of said foot engagement member being a dual lever assembly which comprises at least two levers, said dual lever assembly used to keep said foot support members of said foot engagement member in relatively horizontal positions;

whereby a user may stand upon said foot support members of said foot engagement member and move said foot support members in a reciprocating upward and downward motion, said platform engaging members mounted to said foot support members operatively engaging said guide platform member such that the upward and downward movements of said foot support members of said foot engagement member creates pivoting movement in said lever support member of said foot engagement member, thus creating pivoting movement of said foot support members in the side to side directions as said foot support members move in the upward and downward directions.

10. A pivoting stepper apparatus as claimed in claim 9, said guide platform member of said frame structure member having a relative flat surface, said guide platform member being rigidly mounted to said base frame member of said frame structure member such that said flat surface of said guide platform member is positioned at an angle relative to said base frame member, said guide platform member being angled downward towards said foot engagement member.

11. A pivoting stepper apparatus as claimed in claim 10, each of said platform engaging member of said foot engagement member being an elongated rigid structure rigidly connected to said foot support member and extending towards said guide platform member, said platform engaging member having a wheel element mounted at its end area for rotatably engaging said flat surface of guide platform member.

12. A pivoting stepper apparatus as claimed in claim 11, each of said platform engaging member of said foot engagement member being adjustable and securable at various intervals along respective said foot support member of said foot engagement member; said guide platform member of said frame structure member being adjustable and securable at different angles along said base frame member of said frame structure member; such that the amount of said pivoting motion of said foot engagement member in the side to side directions may be selectively varied.

13. A pivoting stepper apparatus as claimed in claim 9 further comprising a resistance member mounted to said base frame member, said resistance member operatively engaging said lever support member of said foot engagement member, such that said resistance member provides resistance to said pivoting movement of said lever support member; and a handle member mounted t said base frame member.

14. A pivoting stepper apparatus as claimed in claim 13, said resistance member being a conventional chain and sprocket assembly with a flywheel and a resistance varying device.

15. A pivoting stepper apparatus as claimed in claim 13, said resistance member being a conventional resistance cylinder assembly with resistance varying features.

16. A pivoting stepper apparatus comprising;

a frame structure member having a base frame member with a guide platform member mounted thereon;

said guide platform member of said frame structure member having a relative flat surface, said guide platform member being rigidly mounted to said base frame member of said frame structure member such that said flat surface of said guide platform member is positioned at an angle relative to said base frame member, said guide platform member being angled downward towards said foot engagement member;

a foot engagement member having a lever support member pivotally mounted upon said base frame member of said fame structure member; a lever assembly pivotally mounted at its proximate center to said lever support member, two foot support members pivotally mounted to the end areas of said lever assembly such that said foot support members move in a reciprocating upward and downward motion; a platform engaging member mounted to each of said foot support members for operatively engaging said guide platform member of said frame structure member;

each of said platform engaging member of said foot engagement member being an elongated rigid structure rigidly connected to said foot support member and extending towards said guide platform member, said platform engaging member having a wheel element mounted at its end area for rotatably engaging said flat surface of guide platform member;

whereby a user may stand upon said foot support members of said foot engagement member and move said foot support members in a reciprocating upward and downward motion, said platform engaging members mounted to said foot support members operatively engaging said guide platform member such that the upward and downward movements of said foot support members of said foot engagement member creates pivoting movement in said lever support member of said foot engagement member, thus creating pivoting movement of said foot support members in the side to side directions as said foot support members move in the upward and downward directions.

17. A pivoting stepper apparatus as claimed in claim 16, each of said platform engaging member of said foot engagement member being adjustable and securable at various intervals along respective said foot support member of said foot engagement member; said guide platform member of said frame structure member being adjustable and securable at different angles along said base frame member of said frame structure member; such that the amount of said pivoting motion of said foot engagement member in the side to side directions may be selectively varied.

18. A pivoting stepper apparatus as claimed in claim 16, said foot support members of said foot engagement member being generally horizontal in nature, said lever assembly of said foot engagement member being a dual lever assembly which comprises at least two levers, said dual lever assembly used to keep said foot support members of said foot engagement member in relatively horizontal positions.

19. A pivoting stepper apparatus as claimed in claim 16 further comprising a resistance member mounted to said base frame member, said resistance member operatively engaging said lever support member of said foot engagement member, such that said resistance member provides resistance to said pivoting movement of said lever support member; and a handle member mounted to said base frame member.

20. A pivoting stepper apparatus as claimed in claim 19, said resistance member being a conventional chain and sprocket assembly with a flywheel and a resistance varying device.

21. A pivoting stepper apparatus as claimed in claim 19, said resistance member being a conventional resistance cylinder assembly with resistance varying features.

* * * * *